US006026935A

United States Patent [19]

Koh

[11] Patent Number: 6,026,935

[45] Date of Patent: Feb. 22, 2000

[54] CAGE STOP HEIGHT READJUSTING APPARATUS FOR ELEVATOR SYSTEM AND METHOD THEREOF

[75] Inventor: Eun-Man Koh, Changwon, Rep. of Korea

[73] Assignee: LG Industrial Systems Co., Ltd., Seoul, Rep. of Korea

[21] Appl. No.: 09/001,104

[22] Filed: Dec. 30, 1997

[30] Foreign Application Priority Data

Dec. 30, 1996 [KR] Rep. of Korea ..... 96-77554

[51] Int. Cl.[7] ..... B66B 1/42

[52] U.S. Cl. ..... 187/284; 187/394

[58] Field of Search ..... 187/283, 284, 187/291, 394

[56] References Cited

U.S. PATENT DOCUMENTS

| | | | |
|---|---|---|---|
| 4,337,846 | 7/1982 | Yonemoto et al. | 187/284 |
| 4,494,628 | 1/1985 | Uherek et al. | 187/291 |
| 4,719,994 | 1/1988 | Kajiyama | 187/291 |
| 5,686,707 | 11/1997 | Iijima | 187/291 |

*Primary Examiner*—Jonathan Salata

[57] ABSTRACT

A cage stop height readjusting apparatus for an elevator system and a method thereof which are capable of accurately stopping a cage at a predetermined floor at a zero level of a cage stop height. The apparatus includes a position detection rotary encoder for outputting second pulse signal which corresponds to an actual running distance of a cage as a pulley is rotated by a wirET.

8 Claims, 14 Drawing Sheets

FIG. 2
PRIOR ART
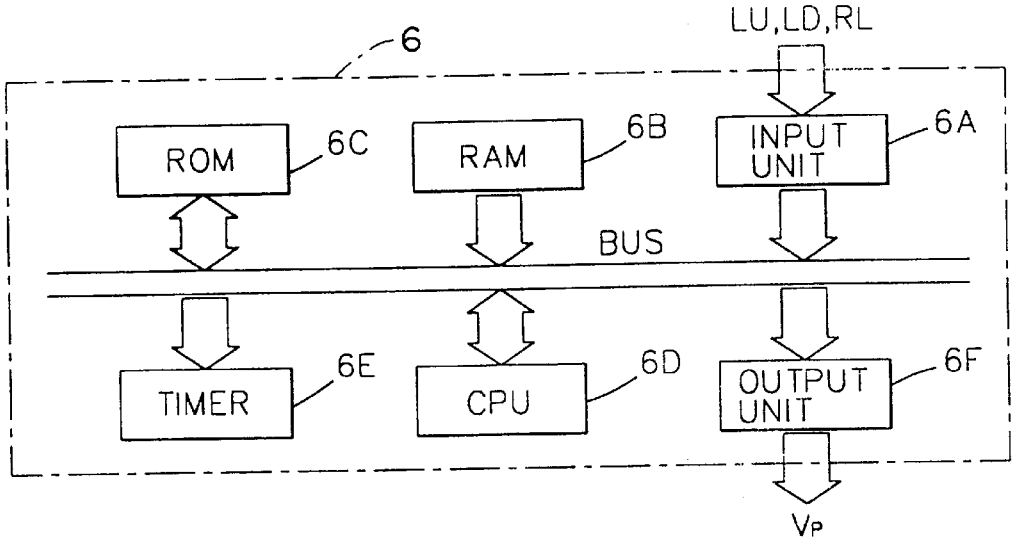
FIG. 3A
PRIOR ART
FIG. 3B
PRIOR ART
FIG. 3C
PRIOR ART
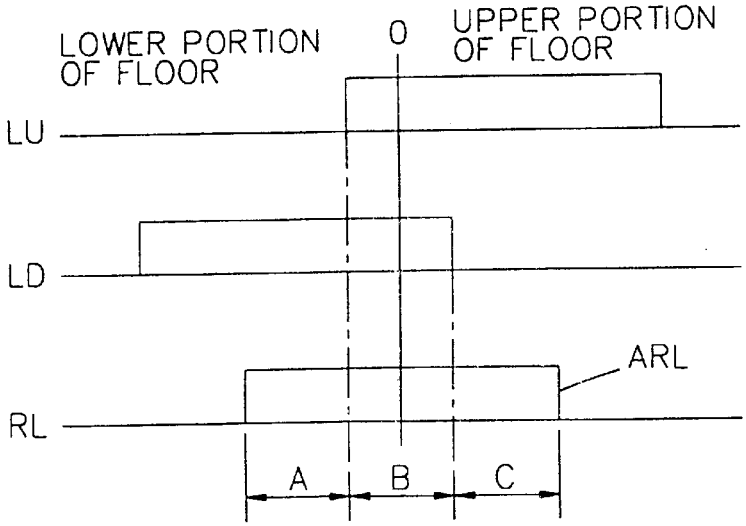

CAGE STOP HEIGHT READJUSTING APPARATUS FOR ELEVATOR SYSTEM AND METHOD THEREOF

BACKGROUND OF THE INVENTION

1. Field of the Invention

The present invention relates to a cage stop height readjusting apparatus for an elevator system and a method thereof, and in particular to an improved cage stop height readjusting apparatus for an elevator system and a method thereof which are capable of accurately stopping a cage or an elevator car at a predetermined floor at a zero level of a cage stop height.

2. Description of the Background Art

Generally, in a conventional elevator system, a sensor connected with a shaft of a cage driving motor generates output pulses proportionally to the RPM of the motor. These output pulses from a rotary encoder are accumulatively summed in accordance with a running direction of the cage, thereby recognizing a synchronous position of the cage.

Therefore, when initially installing an elevator, the height of each floor is measured and stored using the number of output pulses from the rotary encoder based on the position of a reference position (for example, the bottom of the lowest floor of a building). The cage is moved to the floor at which a cage call is generated based on the measured value. At this time, the position in which the bottom of the cage coincides with the height of the floor is called the zero level.

When the cage arrives at the destination floor, the cage often reaches the designated floor at a certain distance away from the zero level due to the erroneous operation of a control apparatus or the characteristics of various sensors. In addition, after the cage arrives, when the load of the cage is varied due to the loading or unloading of the passenger, the elongation of a wire connected with the cage is varied, so that the cage stops at a certain distance short of or over the zero level of the designated floor.

As a result, there may occur a problem such as a passenger getting-on and getting-ff problem due to the difference in height between the height of the desired floor and the height of the bottom of the cage both measured from a set reference position. Therefore, it is required to urgently adjust the stop height of the cage based on the zero level. At this time, the cage has to be re-driven to accurately adjust-the cage stop height. This operation is called a cage stop height readjusting operation.

FIG. 1 illustrates a schematic block diagram illustrating a conventional position control apparatus for a conventional elevator, as disclosed in U.S. Pat. No. 4,719,994 issued on Jan. 19, 1988, which is hereby incorporated by reference. This control apparatus includes a motor 4 for generating a driving force and transferring the force to a sheave 3 for running a cage 1, a speed detection rotary encoder 5 connected with a driving shaft of the motor 4 for outputting a speed signal $V_T$ which is proportional to the RPM of the motor 4, a speed reference signal generator 6 for receiving position detection signals LU, LD and RL from the position detector 1*a*, 1*b*, 1*c* of the cage 1 and generating a speed reference signal $V_P$ for a cage stop height readjusting operation, a subtractor 7 for performing a subtraction operation between a speed signal $V_T$ from the speed detection rotary encoder 5 and a speed reference signal $V_P$ from the reference signal generator 6 and outputting a deviation $V_E$, and a speed control apparatus 8 for controlling the RPM of the motor 4 based on the deviation $V_E$ from the subtractor 7. In the drawings, reference numeral 2 denotes a balance weight.

In addition, the reference speed generator 6 as shown in FIG. 2 includes an input unit 6A for receiving the position detection signals LU, LD and RL, a CPU 6D for processing the position detection signals LU, LD and RL inputted through a ROM 6C, RAM 6B, the input unit 6A and the bus and outputting a reference speed signal $V_P$, a timer 6E for generating a timing signal for an interrupt control, and an output unit 6F for outputting the reference speed signal $V_P$ computed.

The operation of the conventional elevator position control apparatus in FIG. 1 will be explained.

When the cage 1 arrives at the destination floor, the position detectors 1*a* , 1*b*, 1*c* installed on the cage 1 contact the position cam installed on each of the floors, and the position detector signals LU, LD and RL are transmitted to the reference speed generator 6 from the position detectors 1*a*, 1*b*, 1*c*.

FIGS. 3A–3C illustrate operational ranges of the position detection signals LU, LD and RL.

ARL is the cage stop height readjusting zone range, which is composed of the zone A which indicates that the cage stop height readjusting operation is needed in the up-travel direction, the zone B which indicates the normal stop height range, and the zone C which indicates that the cage stop height readjusting operation, is needed in the down-travel direction. Here, the zero point denotes the actual level of the floor.

Therefore, the CPU 6D of the reference speed generator 6 receives the position detection signals LU, LD and RL through the input unit 6A and the bus BUS, executes the program stored in the ROM 6C, and transmits the reference speed signal $V_P$ through the output unit 6F for the cage stop readjusting operation.

FIG. 4 illustrates the patterns of the reference speed signal $V_P$ and the speed signal $V_T$ of the cage 1 for the cage stop height readjusting operation.

In the zone A, the reference speed signal $V_P$ is increased by $\Delta V$ step-by-step as shown in FIG. 4B for increasing the riding-on feeling of the cage, and at the speed $V_{RL}$, for a determined time, the above-described state is maintained. Thereafter, when the cage comes into the zone B of the normal stop height, the reference speed signal $V_P$ becomes 0.

As a result, the speed control apparatus 8 receives the reference speed signal $V_P$ through the subtractor 7, thus driving the motor 4. In the zone A, the cage 1 is moved in the up-travel direction. As shown in FIG. 4, when the reference speed signal $V_P$ becomes 0, the speed signal $V_T$ is gradually decreased and then becomes 0. Therefore, the cage 1 arrives at the zero level.

The cage stop height readjusting operation will now be explained with reference to FIGS. 5 through 8.

When the power is supplied, the program read from the ROM 6C is executed, the reference speed generator 6 is initialized, the timer 6E is driven, and an interrupt signal is inputted.

When the interrupt signal is inputted from the timer 6E, the CPU 6D performs a processing routine for detecting the stop position of the cage 1 as shown in FIG. 5.

Namely, when the interrupt signal is inputted from the timer 6E, the CPU 6D judges whether the cage 1 is running in Step S1. As a result of the judgment, if the cage 1 is running, the flag FLAG is set to 0 in Step S7. If the cage 1 is stopped, it is checked whether the position detection signal RL, namely, the ARL, is at a high level in the zone A in Step S2.

As a result of the checking step, if the ARL is at a high level, the CPU 6D checks the level of the position detection signal LU or the position detection signal LU in the zone A, and thereafter it determines where the cage 1 is stopped among the zones A, B and C in Steps S3 and S4.

If the position detection signal LU is detected to be at a low level in the zone A, the CPU 6D outputs an up movement instruction to the speed control apparatus 8 through the output unit 6F. If the position detection signal LU is at a high level and the position detection signal LD is at a low level in the zone C, the CPU 6D outputs the down movement instruction to the speed control apparatus 8 through the output unit 6F. Thereafter, the flag FLAG is set to 1 in Steps S5, S6 and S8.

In the zone B, the position detection signals LU and LD are all at high levels. If the cage 1 is stopped in the normal zone B in which the cage stop height readjusting operation is not needed, the flag FLAG is set to 0 in Step S7. At this time, the flag FLAG denotes whether the reference speed signal $V_P$ is computed for the cage stop height readjusting operation.

When the processing routine for detecting the stop position of the cage 1 is finished, the CPU 6D checks the flag FLAG. If the flag FLAG is set to 1, the computation processing routine of the reference speed signal $V_P$ as shown in FIG. 6 is performed for the cage stop height readjusting operation.

Namely, if the flag FLAG is set to 1 in Step S9, the CPU 6D checks whether the position detection signals LU and LD are all at high levels in Step S10. As a result of the checking, if the position detection signals LU and LD are all at high levels, the reference speed signal $V_P$ is set to 0 in Step S11.

As a result of the checking, if the position detection signals LU and LD are not all at high levels, the CPU 6D compares the reference speed signal $V_P$ with a constant speed $V_{RL}$ in Step S12. If the speed $V_{RL}$ is not higher than the reference speed signal $V_P$, the reference speed signal $V_P$ is set to the $V_{RL}$ in Step S14 so that the cage 1 is accurately stopped in the normal zone B. If the speed $V_{RL}$ is higher than the reference speed signal $V_P$, the reference speed signal is set to the current reference speed signal $V_P$ plus an increase $\Delta V$ in Step S13.

In addition, FIGS. 7 and 9 illustrate other examples of the patterns between the reference speed signal $V_P$ and the speed signal $V_T$ of the cage 1 for the cage stop height readjusting operation in the conventional art.

FIG. 7 illustrates a pattern when the cage 1 is stopped in the normal zone B. At this time, since the cage 1 moves into the normal zone B before the reference speed signal $V_P$ reaches the speed signal $V_T$ of the cage 1, the reference speed signal $V_P$ becomes 0.

Therefore, even when the cage stop height readjusting operation is finished, the distance L which is a distance from the zero level is increased compared to the distance as shown in FIG. 4.

In addition, FIG. 8 illustrates a pattern for overcoming the problems which occur in the example of FIG. 7. As shown therein, when the cage 1 is moving, the reference speed signal $V_P$ is increased up to $V_M$, and then the same is slightly decreased down to a predetermined speed $V_{RL}$. As a result, since the reference speed signal $V_P$ of the cage 1 is quickly increased and is larger than the pattern shown in FIG. 7, it is possible to shorten the distance L which is at a certain distance from the zero level.

Namely, if the flag FLAG is set to 1, the CPU 6D checks whether the position detection signals LU and LD are all at high levels in Steps S15 and S16. As a result, if the position detection signals LU and LD are all at high levels, the reference speed signal $V_P$ is set to 0, and the flag STA is set to 0 in Steps S17 and S18 for the cage stop height readjusting operation.

If the position detection signals LU and LD are all at low levels, it is checked in Step S19 whether the flag STA is set to 0. As a result, if the flag STA is set to 0, the CPU 6D sets the reference speed signal $V_P$ to a certain speed $V_M$ in Step S20. In addition, the flag STA is set to 1 in Step S21. At this time, $V_M$ becomes two or three times the $V_{RL}$.

If the flag STA is not set to 0, the CPU 6D compares the reference speed signal $V_P$ with the speed $V_{RL}$ in Step S22. If the speed $V_{RL}$ is larger than the reference speed signal $V_P$, the reference speed signal $V_P$ is set to $V_P+\Delta V$ in Step S23, and if the speed $V_{RL}$ is smaller than the reference speed signal $V_P$, the reference speed signal $V_P$ is set to $V_{RL}$ in Step S24. Thereafter, the cage 1 is accurately stopped in the normal zone B.

Therefore, when the cage 1 is stopped in the normal zone B, since the cage 1 is re-driven using the reference speed signal $V_P$, it is possible to shorten the distance L which is a certain distance from the zero level.

However, even when the cage stop height readjusting technique as shown in FIGS. 8 and 9 is used, in the conventional art since the cage 1 stops at a distance L from the zero level, there is a big problem for accurately stopping the cage at the zero level.

SUMMARY OF THE INVENTION

Accordingly, it is an object of the present invention to provide a cage stop height readjusting apparatus for an elevator system and a method thereof which overcome the aforementioned and other problems encountered in the background art.

It is another object of the present invention to provide a cage stop height readjusting apparatus for an elevator system and a method thereof which are capable of accurately stopping a cage at a predetermined floor at a zero level of a cage stop height.

To achieve the above and other objects, there is provided a cage stop height readjusting apparatus for an elevator system, which includes a position detection rotary encoder for outputting a second pulse signal which corresponds to an actual running distance of a cage as a pulley is rotated by a wire connected with the cage, and a main controller for receiving first and second position detection signals from first and third position detectors and first and second pulse signals from the speed detection rotary encoder and the position detection rotary encoder when the cage is stopped in a cage stop height readjusting zone, computing a cage stop height adjusting distance, and outputting a speed instruction signal for the cage stop height adjusting operation based on the computed cage stop height adjusting distance.

To achieve the above and other objects, there is provided a cage stop height readjusting method for an elevator system, which includes a first step for obtaining minimum values of first and second position detection signals from the position detectors when the cage is stopped at a stop level and obtaining maximum values of the first and second detection signals when the cage is stopped at a certain distance from the stop level, a second step for initializing a buffer storing a relative distance value when the cage comes into a door zone and storing a running direction of the cage, a third step for storing the value, which is obtained by accumulatively summing the number of pulses in the second pulse signal output from the position detection rotary encoder, into a buffer as the relative distance value until the cage coming to the door zone is stopped, a fourth step for reading the stored running direction of the cage when the cage is stopped in the cage stop height adjusting zone and obtaining the current position of the stopped cage, a fifth step for computing a cage stop height adjusting distance between the zero level to the current position at which the cage is stopped, a sixth step for computing a speed pattern constant value for obtaining a speed pattern for re-running by the computed cage stop height adjusting distance after setting the re-running direction, and a seventh step for generating a shaped speed pattern based on the computed speed pattern constant value, generating the final speed instruction signal based on the generated speed pattern and re-running the cage.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2 is a view illustrating -a speed reference signal generation apparatus of FIG. 1;

FIG. 3 is a view illustrating operational ranges of a position detector of FIG. 1;

DETAILED DESCRIPTION OF THE PREFERRED EMBODIMENTS

Figure 1:
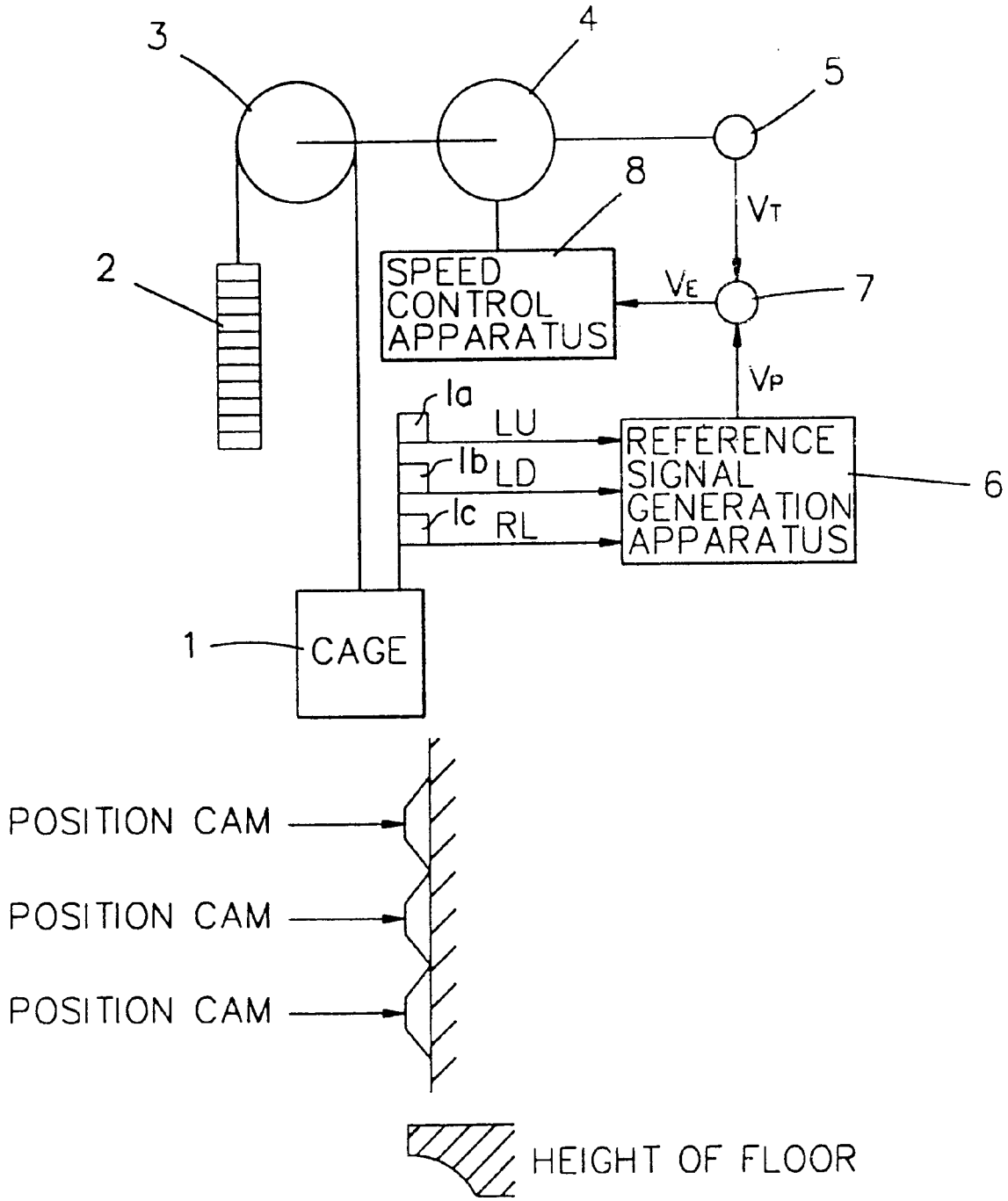
FIG. 1 PRIOR ART
FIG. 1 is a view illustrating a running control apparatus for a conventional elevator system.
Figure 4A:
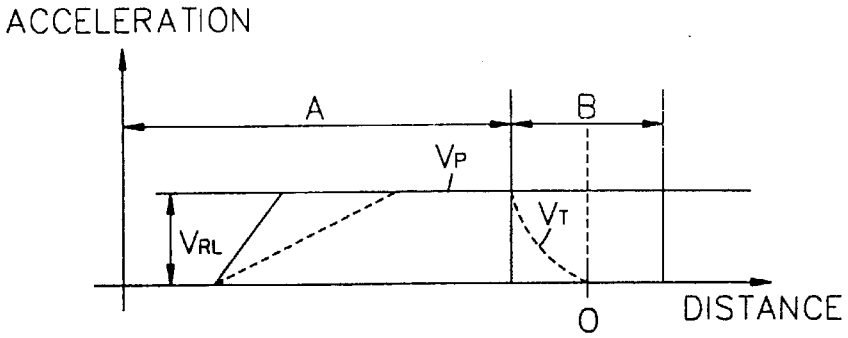
FIG. 4A PRIOR ART
FIG. 4 is a view illustrating the patterns of a speed reference signal $V_P$ for a cage stop height adjusting operation in the conventional art.
Figure 4B:
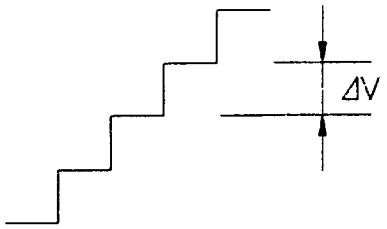
FIG. 4B PRIOR ART
Figure 5:
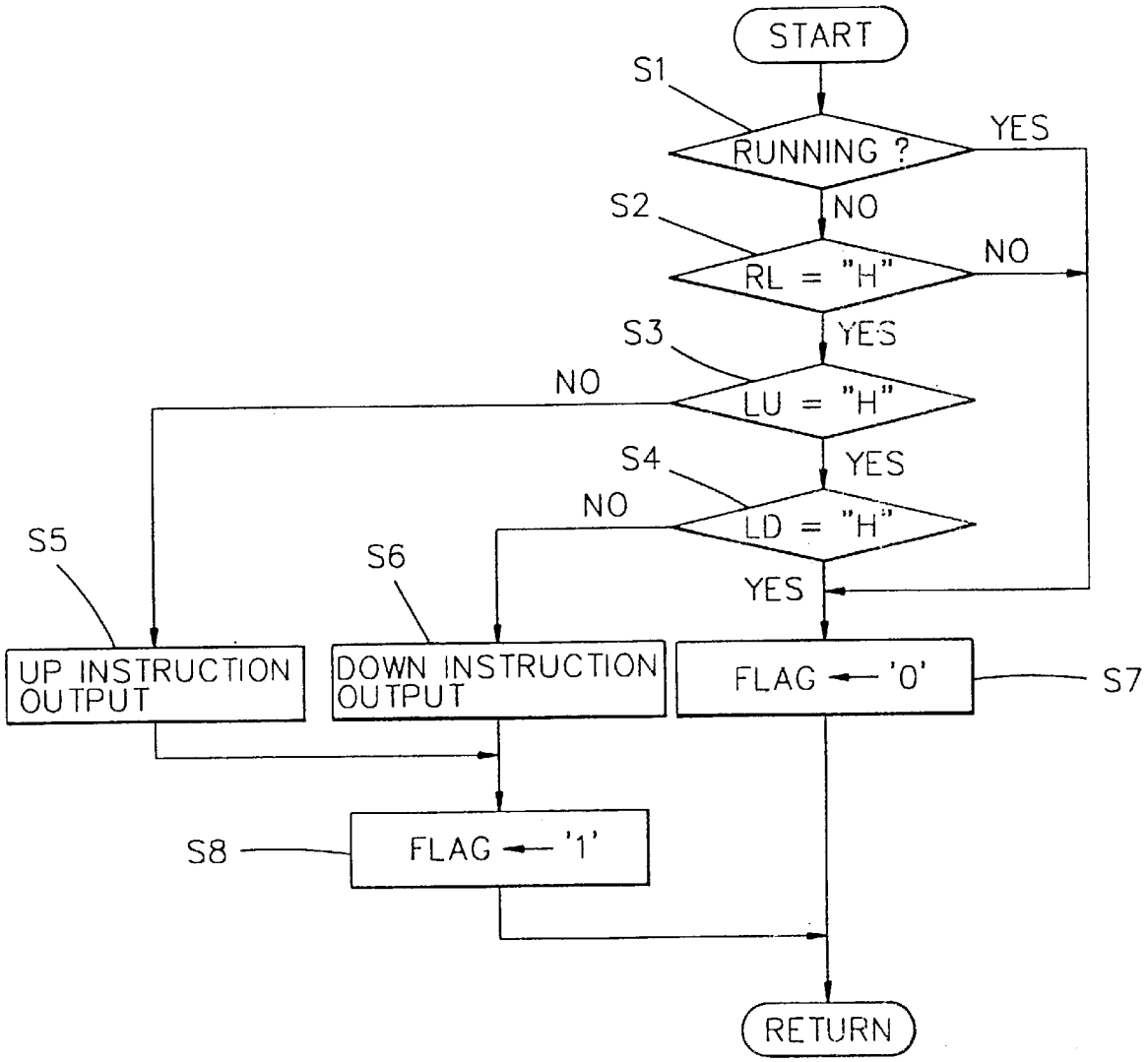
FIG. 5 PRIOR ART
FIG. 5 is a flowchart illustrating a method for detecting a cage stop position in the conventional art.
Figure 6:
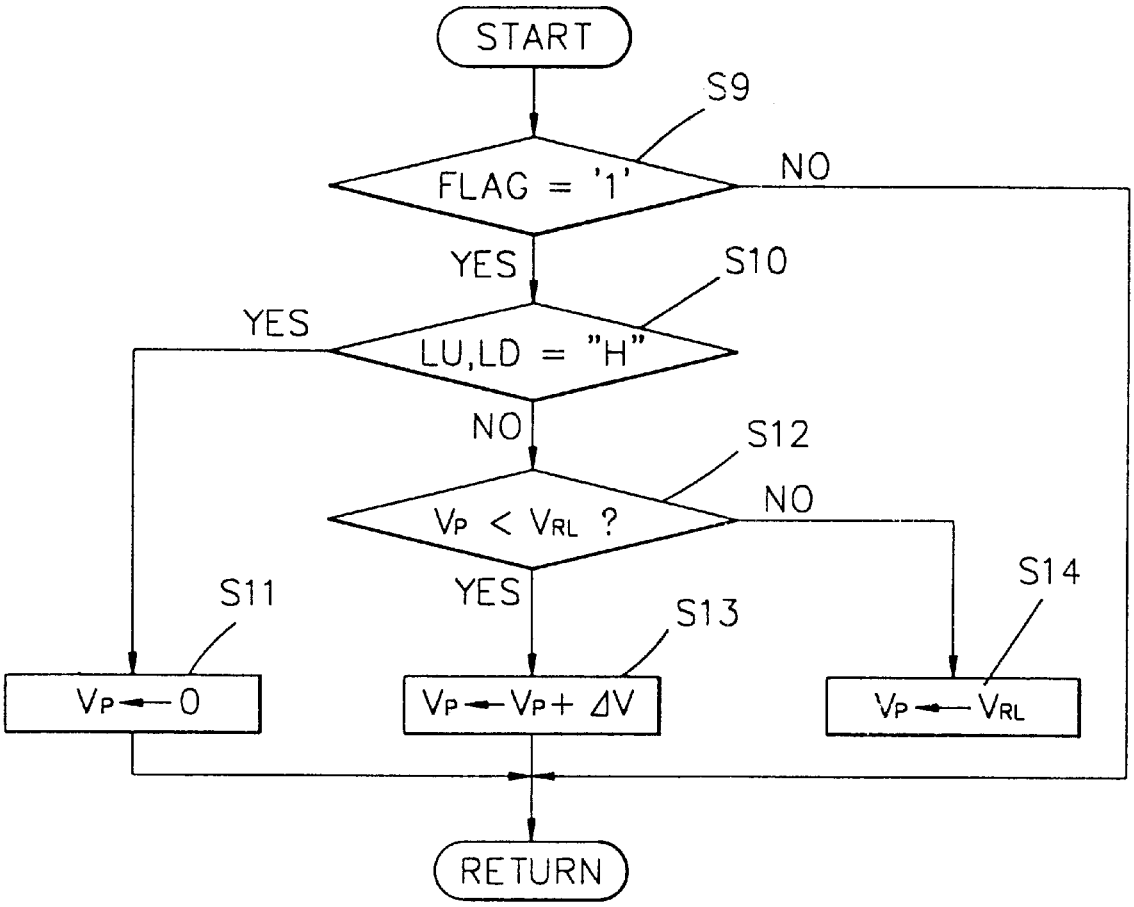
FIG. 6 PRIOR ART
FIG. 6 is a flowchart illustrating a reference speed signal $V_P$ for a cage stop height adjusting operation in the conventional art.
Figure 7:
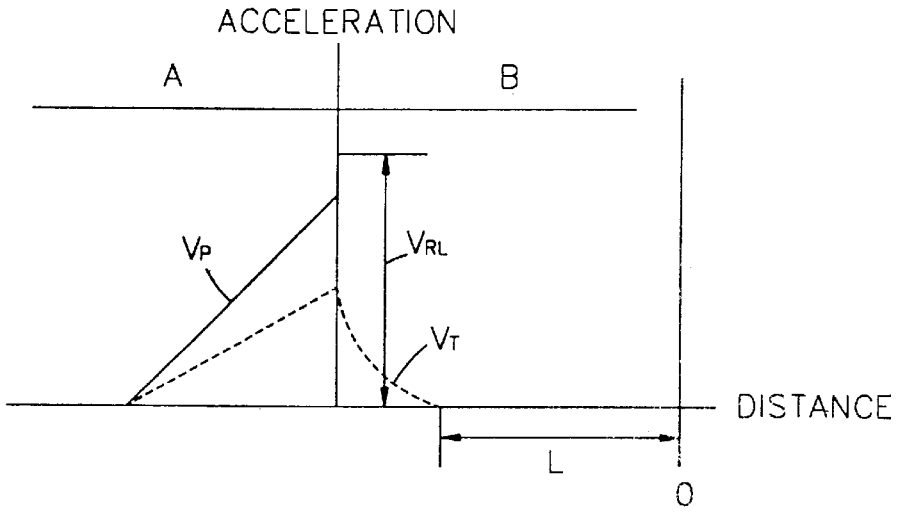
FIG. 7 PRIOR ART
FIG. 7 is a view illustrating an interrelationship between a speed reference signal $V_P$ and a cage speed pattern in the conventional art.
Figure 8:
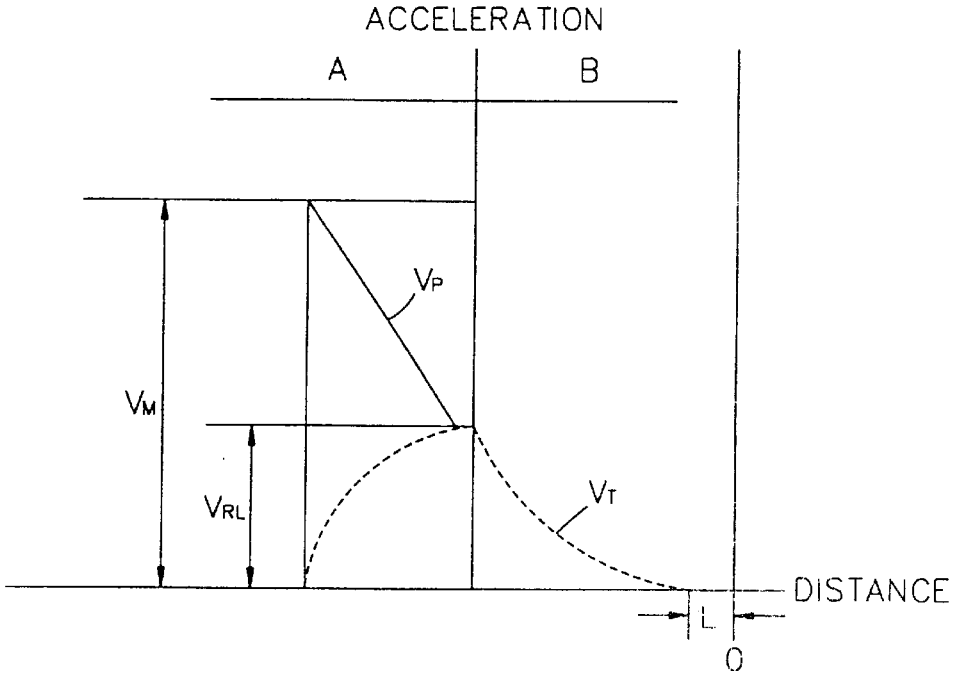
FIG. 8 PRIOR ART
FIG. 8 is a view illustrating another interrelationship between a speed reference signal $V_P$ and a cage speed pattern in the conventional art.
Figure 9:
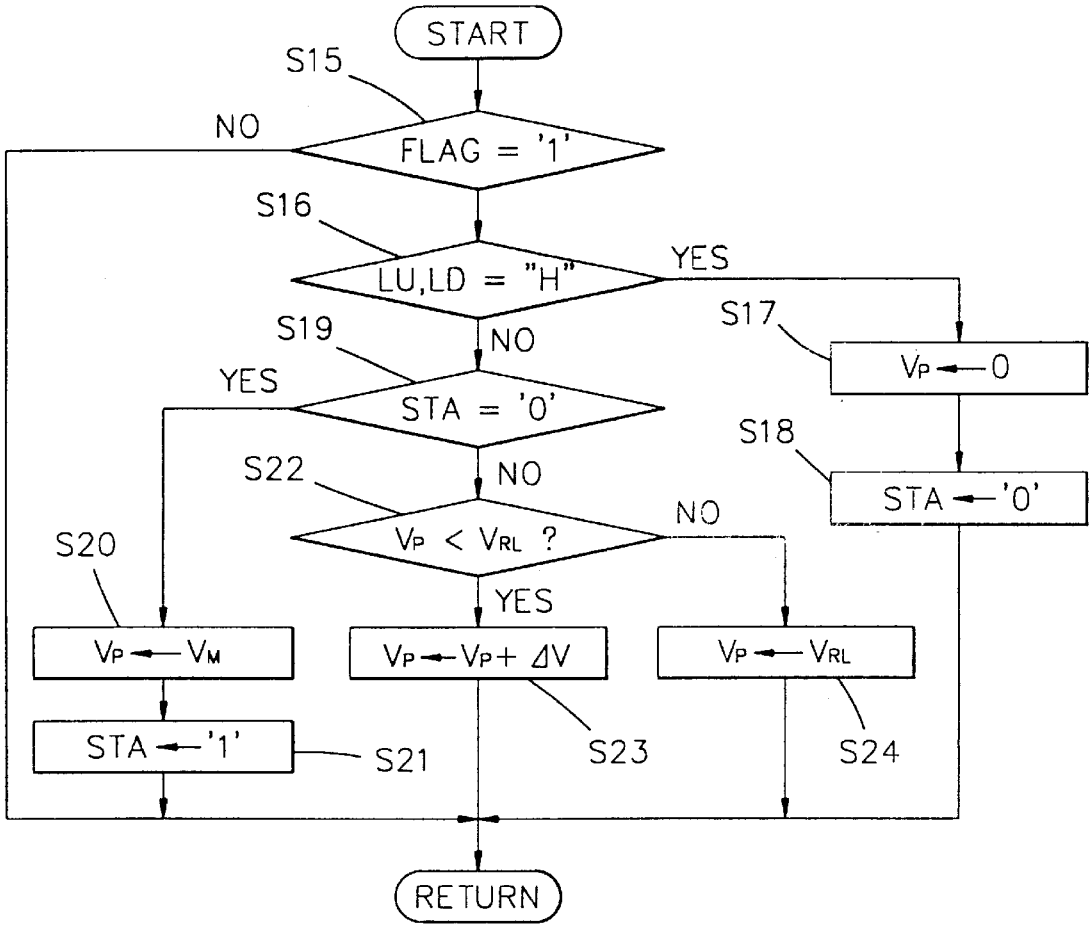
FIG. 9 PRIOR ART
FIG. 9 is a flowchart illustrating a flowchart for a cage stop height adjusting operation for an elevator system of FIG. 1.
Figure 10:
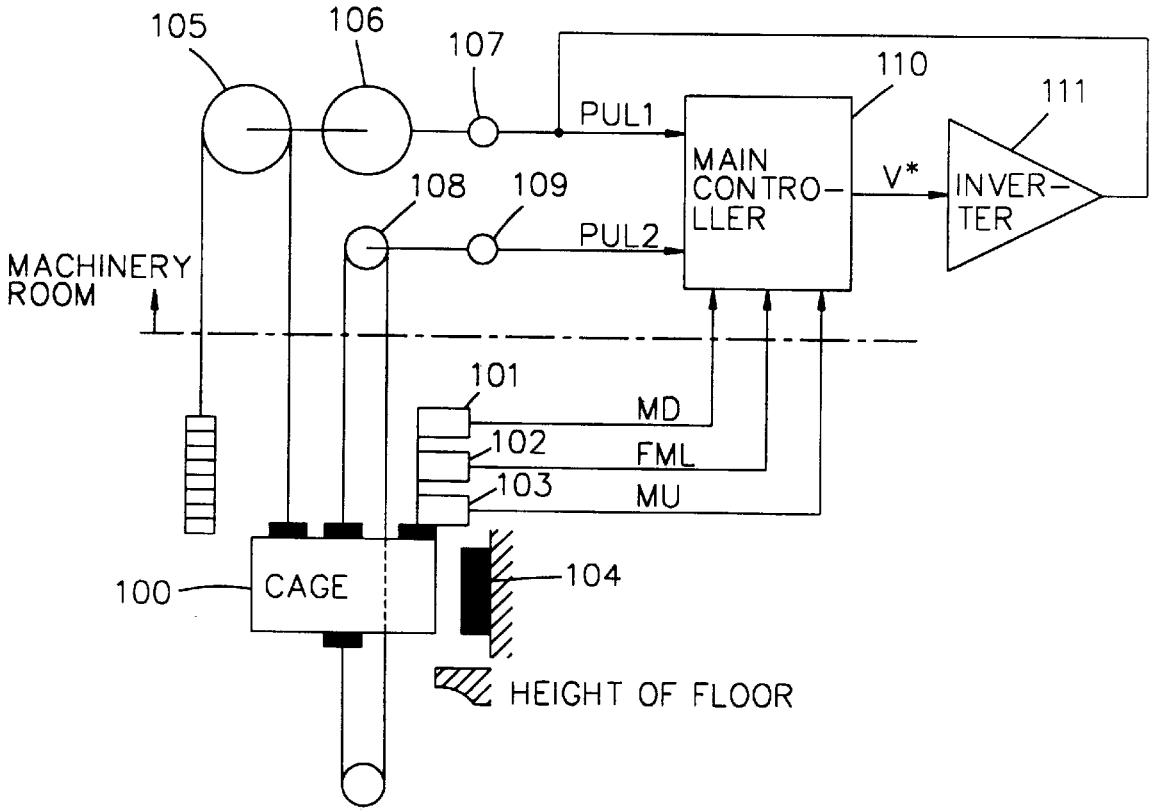
FIG. 10 is a view illustrating a cage stop height readjusting apparatus for an elevator system according to the present invention.
Figure 11:
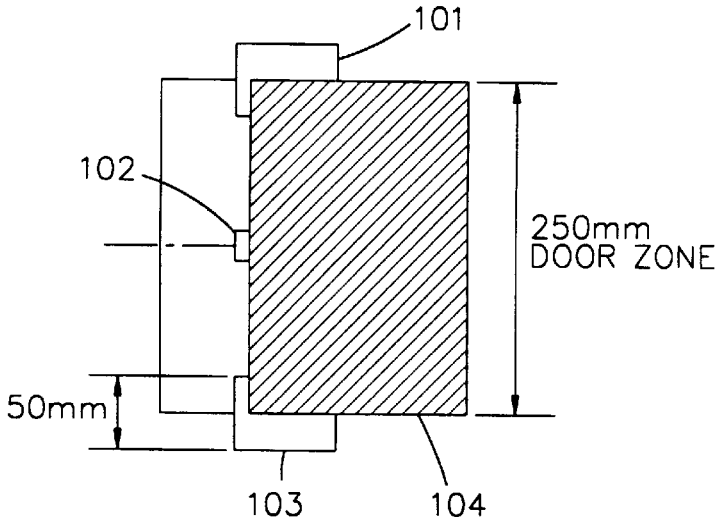
FIG. 11 is a view illustrating a state that a position detector is shielded by a shielding plate of FIG. 10.

FIG. 10 illustrates an embodiment of the cage stop height readjusting apparatus for an elevator system according to the present invention.

As shown therein, position detectors 101 through 103 are installed on the cage 100. A shielding plate 104 is installed in each cage moving path of a corresponding floor to correspond with the position detectors 101 through 103. When the cage 100 stops at the zero level, as shown in FIG. 13B, the position detector 102 stops at the center of the shielding plate 104, and the position detectors 101 through 103 are shielded by a predetermined range thereof (for example, the half portion each thereof).

In addition, there are provided a pulley 108 which is rotated by a connection with the cage 100, a position detection rotary encoder 109 for outputting a pulse signal PUL2 corresponding to the actual running distance of the cage 100 as the pulley 108 is rotated, a main controller 110 for receiving position detection signals MD, FML and MU from the position detectors 101 through 103 and pulse signals PUL1 and PUL2 from the speed detection rotary encoder 107 and the position detection rotary encoder 109, and outputting a speed instruction signal V*, and an inverter 111 for phase-converting the speed instruction signal V* and driving a motor 106. In the drawings, reference number 105 denotes a sheave.

Figure 12:
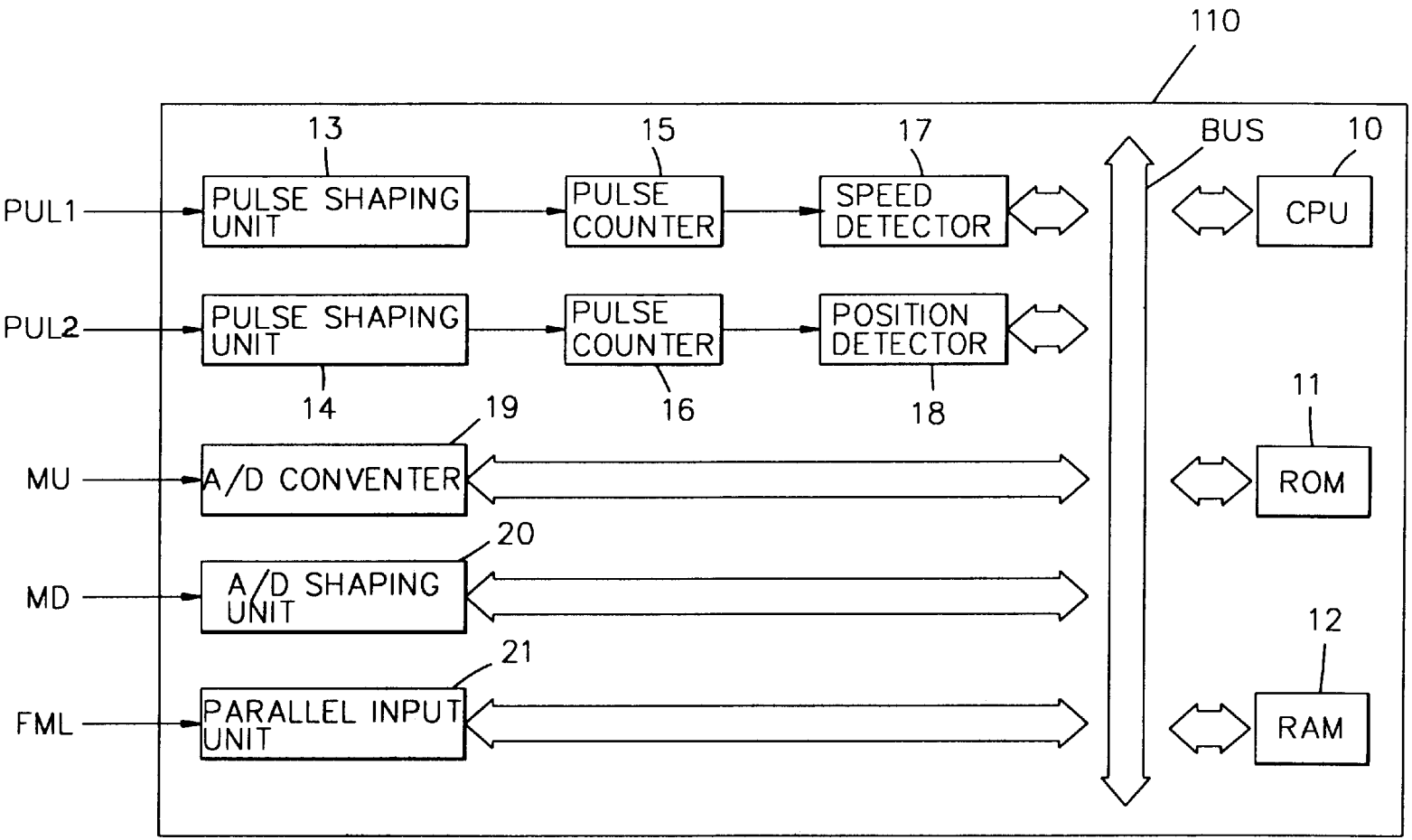
FIG. 12 is a detailed view illustrating a main controller of FIG. 10.

As shown in FIG. 12, the main controller 110 basically includes the CPU 10, ROM 11 and RAM 12 and further includes pulse shaping units 13 and 14 for shaping the pulse signals PUL1 and PUL2 from the speed and position detection rotary encoders 107 and 109, pulse counters 15 and 16 for accumulatively summing and subtracting the output signals from the pulse shaping units 13 and 14, speed and position detectors 17 and 18 for detecting the speed and position of the cage 100 based on the output signals from the pulse counters 15 and 16, A/D converters 19 and 20 for analog-to-digital converting the position detection signals MU and MD, and a parallel input unit 21 for inputting the position detection signal FML.

The operation of the cage stop height readjusting operation of the elevator system according to the present invention will now be explained with reference to the accompanying drawings.

When the cage 100 arrives at a destination floor, the position detectors 101 through 103 installed on the upper portion of the cage 100 output position detection signals MD, FML and MU to the main controller 110 based on the shielding operation of the shielding plate 104.

In addition, the speed detection rotary encoder 107 connected with a driving shaft of the motor 106 outputs a pulse signal PUL1 proportional to the RPM of the motor 106, and the position detection rotary encoder 109 outputs a pulse signal PUL2 corresponding to the actual running distance of the cage 100 based on the rotation of the pulley 108.

Figure 13A:
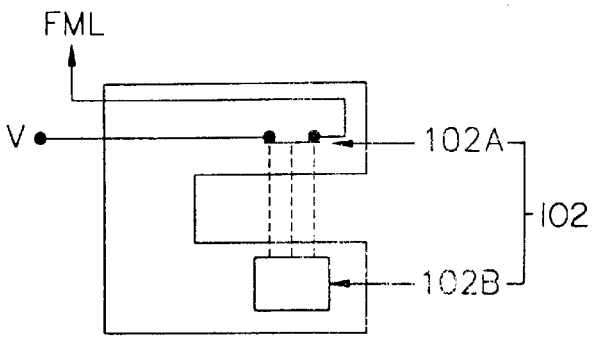
FIGS. 13 and 14 are views illustrating an operational principle of a position detector of FIG. 10.
Figure 13B:
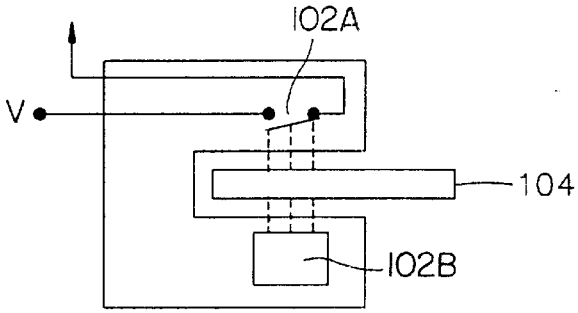
Figure 17:
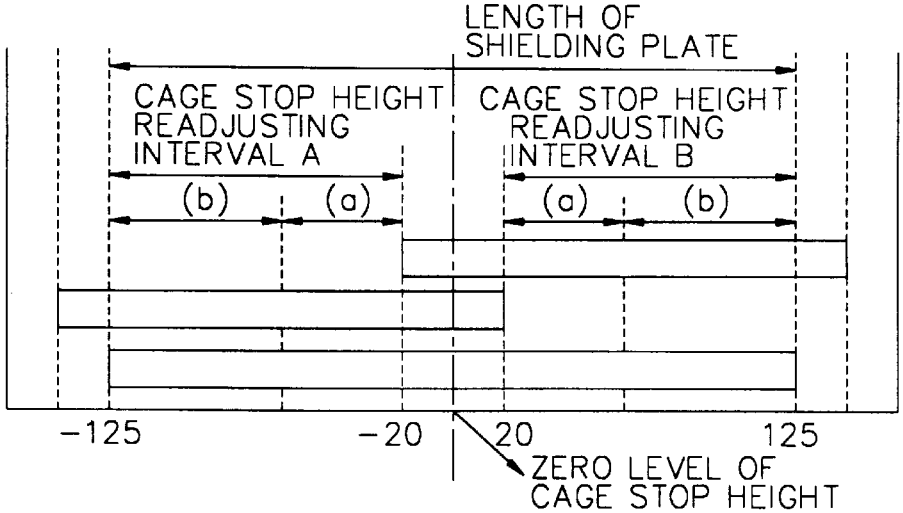
FIG. 17 is a view illustrating a cage stop height readjusting zone according to the present invention.

FIG. 13 illustrates an operational principle of the position detector 102. The position detector 102 includes a read switch 102A and a permanent magnet 102B. At the usual time, the read switch 102A remains in an OFF state by the magnetic flux of the permanent magnet 102B as shown in FIG. 13A. When the cage 100 is stopped at a predetermined floor, the magnetic flux is shielded by the shielding plate 104, and the read switch 102A is opened as shown in FIG. 13B. Therefore, the operational range of the position detector 102 is defined by the range of the length of the shielding plate 104 with respect to the zero level of the cage stop height as shown in FIG. 17.

Figure 14:
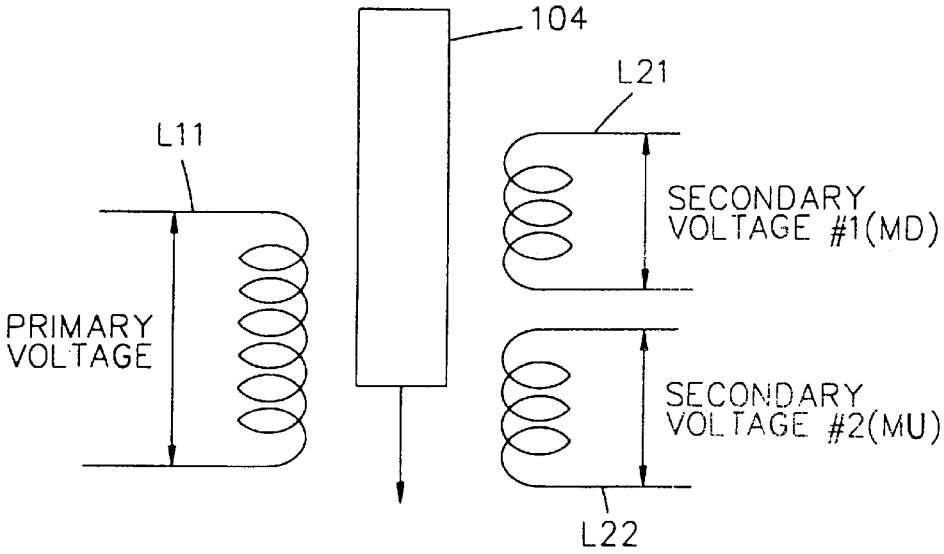
Figure 18:
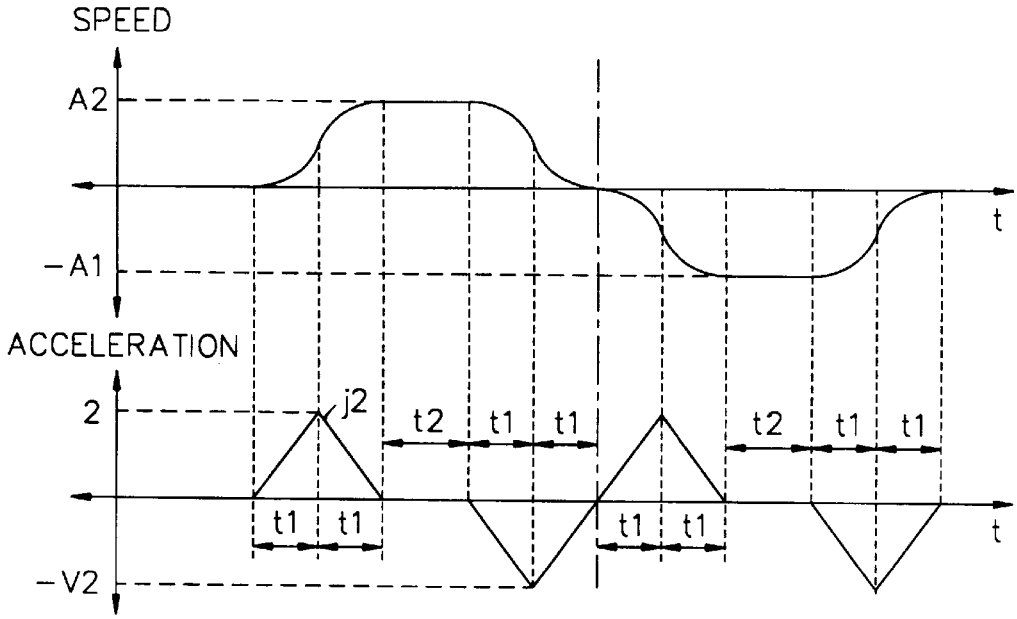
FIG. 18 is a view illustrating a speed and acceleration of a cage in a cage stop height readjusting zone according to the present invention.

In addition, FIG. 14 illustrates an operation principle of the position detectors 101 and 103. The voltage, which is induced between the primary coil L11 and the secondary coils L21 and L22, is outputted as the position detection signals MD and MU. When the cage 100 stops at the zero level, the induced voltage is shielded by the shielding plate 104. At this time, if the shielding operation is not performed by the shielding plate 104, assuming that the voltage values (digitalized) of the position detection signals MU and MD are 255, and the digital value is 0 when the shielding is fully performed, the operational range of the position detectors 101 and 103 is smaller than 200 as shown in FIG. 18. Other types of position detectors 101 through 103 may be used.

Therefore, the main controller 110 receives the pulse signals PUL1 and PUL2 from the speed and position detection rotary encoders 107 and 109, and these signals are shaped by the pulse shaping units 13 and 14. A number of pulses are accumulatively summed or subtracted by the pulse counters 15 and 16. The speed and position detectors 17 and 18 respectively detect the running speed and position of the cage 100 based on the counted values of the pulse counters 15 and 16, and output the results to the CPU 10 through the bus BUS.

In addition, the A/D converters 19 and 20 receive the position detection signals MU and MD induced by the secondary coils L21 and L22 of the position detectors 101 and 103, converts the same into digital values 0 through 255 and outputs the results to the CPU 10. The output values from the A/D converters 19 and 20 are shown in FIG. 18. In addition, the parallel input unit 21 for processing the ON/OFF signals converts the position detection signal FML from the position detector 102 into ON-OFF signals.

Therefore, the CPU 10 performs an arithmetic operation with respect to the data using the program read from the ROM 11, and the speed instruction signal V* is outputted to the inverter 111. The inverter 111 converts the phase of the speed instruction signal V* and drives the motor 106 according to the speed instruction signal V*.

As shown in FIG. 17, assuming that the length of the shielding plate 104 is 250 mm, the cage 100 is stopped at a distance of ±125 mm from the zero level, and the widths of the door zone and the position detectors 101 and 103 are 50 mm, respectively, then the position of the cage 100 is arranged from +125 mm through +20 mm or −125 mm through −20 mm as the cage stop height readjusting zone.

Therefore, when the cage 100 comes into the door zone, the main controller 110 accumulatively sums the number of pulse signals PUL2 from the rotary encoder 108 from the time when the output value MD from the position detector 101 or the output value MU from the position detector 103 becomes smaller than 128 to the time when the same becomes larger than 128 as shown in FIG. 18.

Thereafter, when the cage 100 is stopped within the cage stop height readjusting zone, the distance, namely, 125 mm, from the zero level to the position at which the cage 100 is stopped is computed based on the number of stored pulses. Thereafter, the speed pattern by which the cage 100 re-runs for the computed distance is generated.

Next, the cage stop height readjusting operation will now be explained.

First, when repairing or maintaining the elevator system, a user positions the cage 100 at the level of a corresponding floor and sets the flag SREQ, which indicates the minimum value setting request, to 1. Then the minimum values MU_LR and MD_LR of the position detection signals MU and MD output from the position detectors 101 and 103 are obtained, and the flag SREQ is set to 0.

In addition, the cage 100 is moved to the positions 0 through ±250 which are at a certain distance from the stop level, and the flag SREQ is set to 2 at the position. The maximum values MU_MR and MD_MR of the position detection signals MU and MD from the position detectors 101 and 103 are stored. At this time, the flag (SREQ)="1" indicates the minimum value setting request, and the flag (SREQ)="2" indicates the maximum value setting request.

Figure 19:
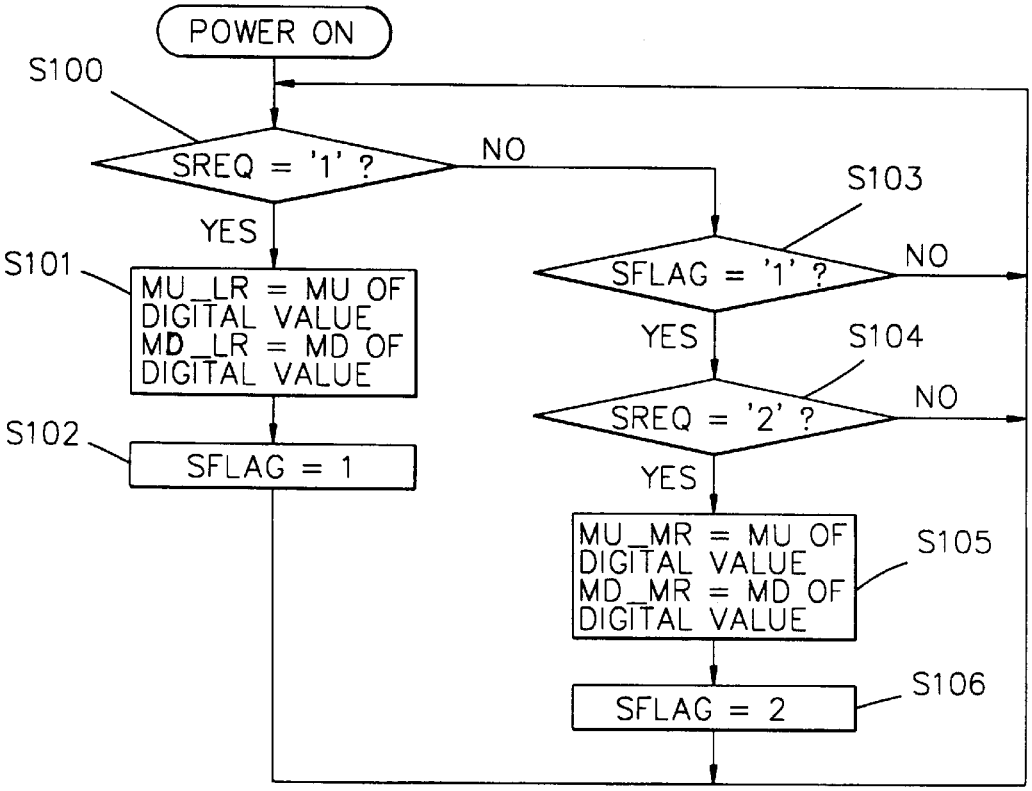
FIG. 19 is a flowchart illustrating a minimum value and maximum value setting method of a position detection signal form a position detector according to the present invention.
Figure 20:
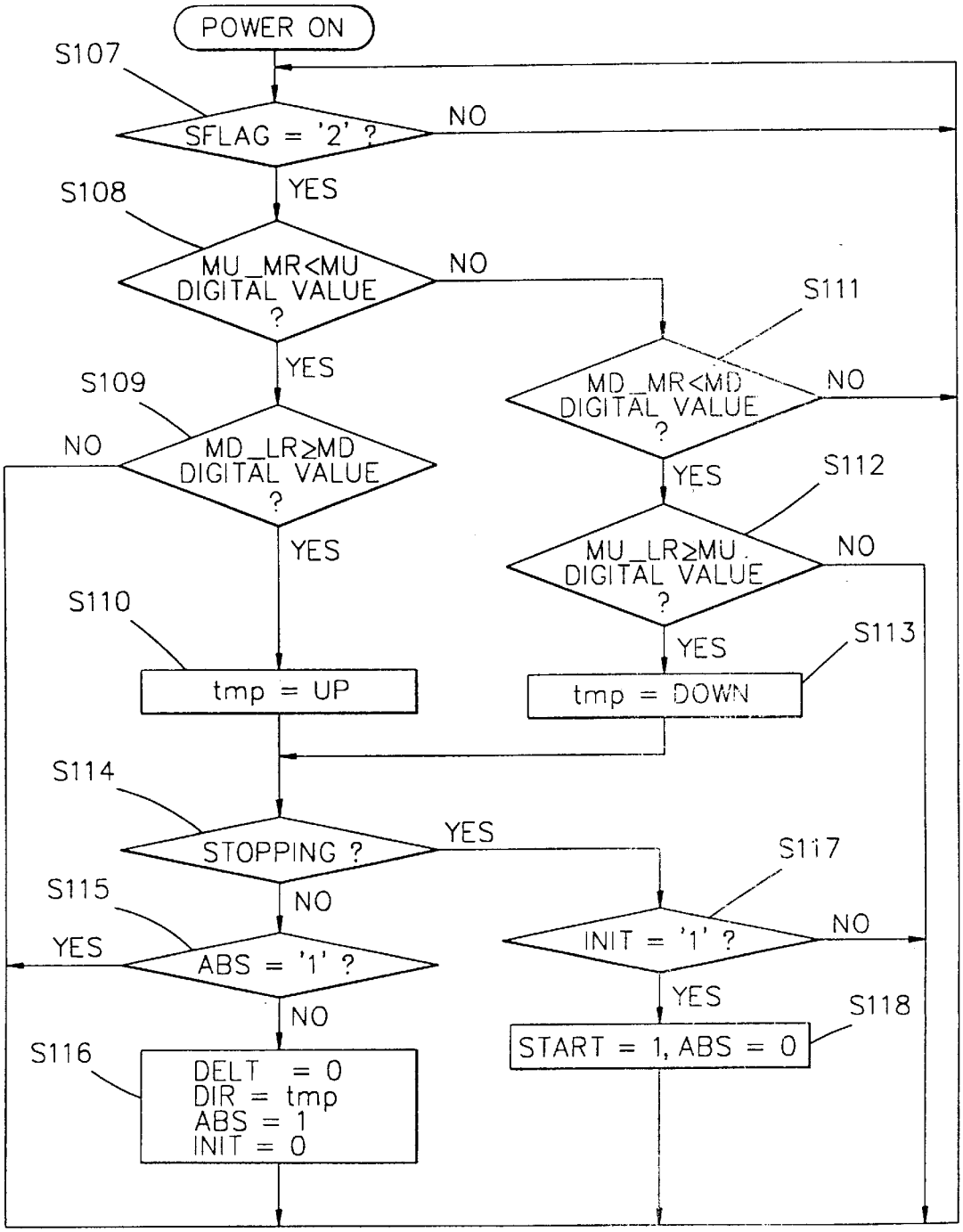
FIGS. 20 and 21 are flowcharts illustrating a method for a cage stop height readjusting operation of an elevator system of FIG. 10.

Namely, as shown in FIG. 19, the CPU 10 checks whether the minimum value setting request is generated by a user in Step S100, and as a result of the checking, if there is a maximum value setting request, the digital values of the position detection signals MU and MD are received through the A/D converters 19 and 20. The digital values of the position detection signals MU and MD are stored into the RAM 12 as the minimum values MU_LR and MD_LR of the position detection signals MU and MD in Step S101, and the flag SFLAG is set to "1", thus indicating the minimum value setting completion in Step S102.

In addition, if the flag SREQ is not set to 1, it is checked whether the minimum value setting operation is finished in Step S103. When the minimum value setting is finished, it is checked whether there is a maximum value setting request in Step S104. If there is the maximum value setting request, the digital values of the position detection signals MU and MD are received through the A/D converters 19 and 20. The digital values of the position detection signals MU and MD are stored into the RAM 12 as the maximum values MU_MR and MD_MR of the position detection signals MU and MD in Step S105, and the flag SFLAG is set to 2, thus indicating the maximum value setting completion in Step S106. As this time, the flag SFLAG is the flag which indicates the minimum value and maximum value setting completion of the position detectors 101 and 103.

Thereafter, when the cage 100 comes into the door zone, the position detectors 101 and 103 are shielded by the shielding plate 104. At this time, the CPU 10 checks whether the maximum value setting operation is finished in Step S107. When the maximum value setting is finished, if the maximum value MU_MR of the position detection signal MU is smaller than the digital value of the position detection signal MU which is currently detected by the position detector 103 in Step S108, and at the same time if the minimum value MD_LR of the position detection signal MD is larger than or identical to the digital value of the position detection signal MD which is currently detected by the position detector 101 in Step S109, the cage stop height readjusting interval (zone) A is set as shown in FIG. 17, and the running direction tmp of the cage 100 is in the up direction in Step S110.

In addition, if the maximum value MD_MR of the position detection signal MD is smaller than the digital value of the position detection signal MD which is currently detected by the position detector 101 in Step S111, and at the same time if the minimum value MU_LR of the position signal MU is larger than or identical to the digital value of the position detection signal MU which is currently detected by the position detector 103 in Step S112, the cage stop height readjusting interval (zone) B is defined as shown in FIG. 17, and the running direction tmp of the cage 100 is in the down direction in Step S113. Thereafter, it is checked whether the cage 100 is stopped in Step S114.

At this time, if the absolute value computation flag ABS is not set to 1 in Step S115, then the absolute value computation flag ABS is set to 1, the buffer DELT into which the relative distance value is stored is initialized, the flag INT which indicates the initialization of the buffer DELT is initialized, and the running direction tmp is stored in Step S116. In addition, if the cage 100 is stopped in the cage stop height readjusting zone (interval), and the buffer DELT is initialized in Step S117, then the flag START is set to 1 which indicates that the current position of the cage 100 is computed. If a predetermined condition is generated for the next cage stop height readjusting operation, the absolute value computation flag ABS is initialized for the cage stop height readjusting operation in Step S118.

Figure 21:
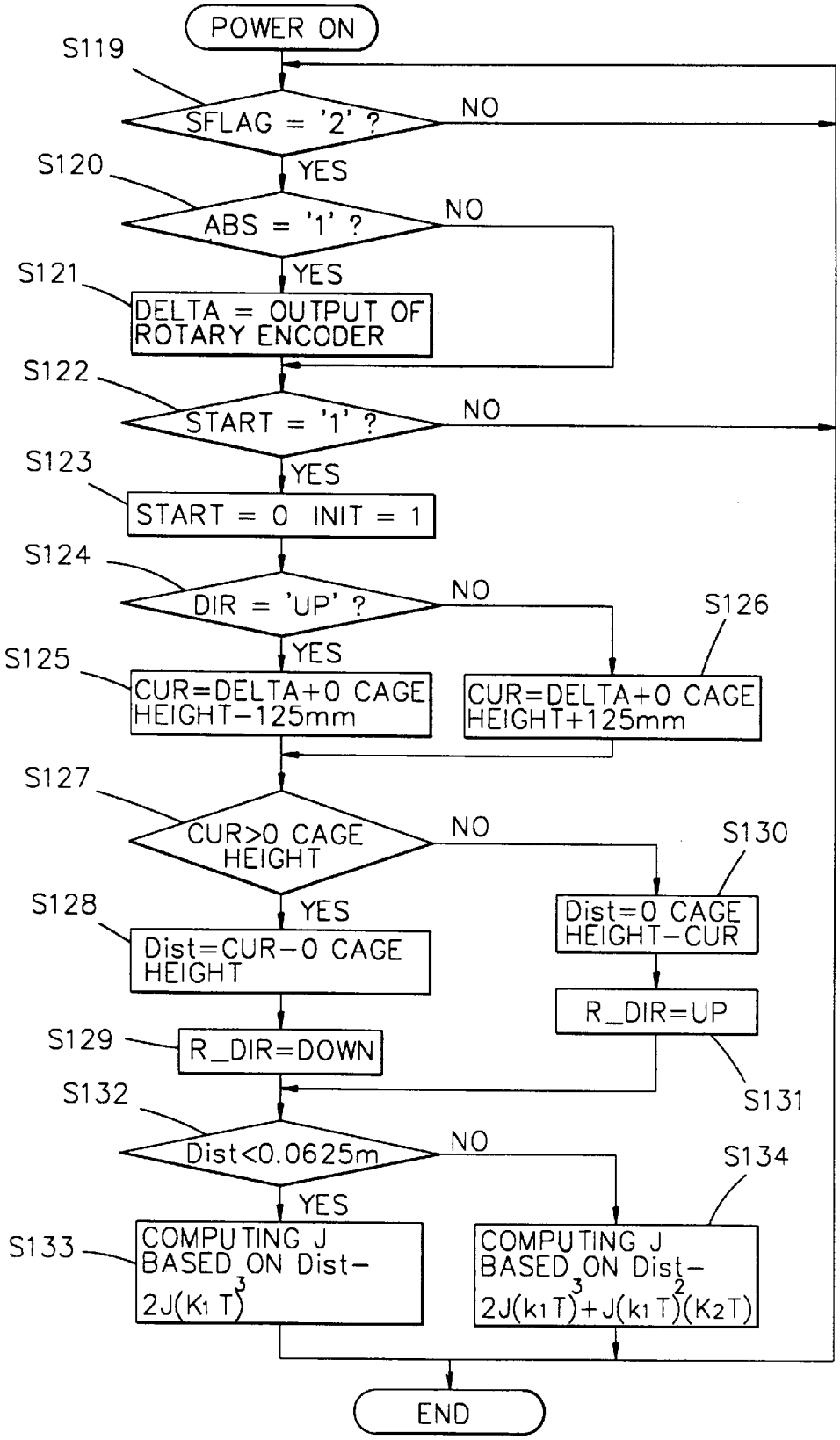

In a state where the maximum value setting is completed in Step S119, as shown in FIG. 21, when a request is generated for computing the relative distance value in Step S120 (ABS=1), the value which is obtained by accumulatively computing the pulse signals PUL2 from the position detection rotary encoder 108 at the door zone entering position, namely, the position at which the cage 100 is stopped from the shielding position, is stored into the buffer DELT in Step S121, and it is checked that whether there is a request for computing the current position CUR at which the cage 200 is positioned in Step S122.

As a result of the checking, if there is a request for obtaining the current position CUR of the cage 100 stopped, the flag START is initialized, and the flag INIT is set to 1 in Step S123. If the cage 100 is moved in the up-direction, the current position CUR is obtained based on the value of "the stored value of the buffer DELT+the zero level−125 mm" in Steps S124 and S125. If the cage 100 is moved in the down-direction, the current position CUR is obtained based on the stored value of "the buffer DELT+the zero level value+125 mm" in Step S126. Thereafter, the distance from the zero level to the position at which the cage is currently stopped (namely, the cage stop height readjusting distance Dist) is computed, and the speed pattern is generated for re-running the cage 100 by the computed distance Dist.

Namely, if the current position CUR of the cage 100 is larger than the zero level, the zero level is subtracted from the current position CUR, thus computing the cage stop height adjusting distance Dist, and the cage 100 is set to move in the down-direction for performing the cage stop height readjusting operation by the cage stop height adjusting distance Dist in Steps S127 through S129. If the current position CUR of the cage 100 is smaller than the zero level, the current position CUR is subtracted from the zero level, thus computing the cage stop height adjusting distance Dist, and the running direction R_DIR of the cage 100 is set to be moved in the up-direction for performing the cage stop height adjusting operation by the cage stop height adjusting distance Dist in Steps S130 and S131.

In addition, constant values T1, T2 and J1 are obtained for re-running the cage 100 based on the computed cage stop height adjusting distance Dist. At this time, the speed pattern shown in FIG. 18 may be expressed in the following Equation (1).

$$Dist=2J(k_1T)^2(k_2T) \qquad \text{Equation (1)}$$

where the reference value of J is 0.25, and since T1 is fixed, the value may be divided based on the zone. At this time, the reference value for dividing the zone is the maximum distance (0.625 m) when t2 is 0 as shown in FIG. 18. Therefore, the type of the speed pattern is divided into the types shown in FIGS. 15 and 18 based on the maximum distance.

Figure 15:
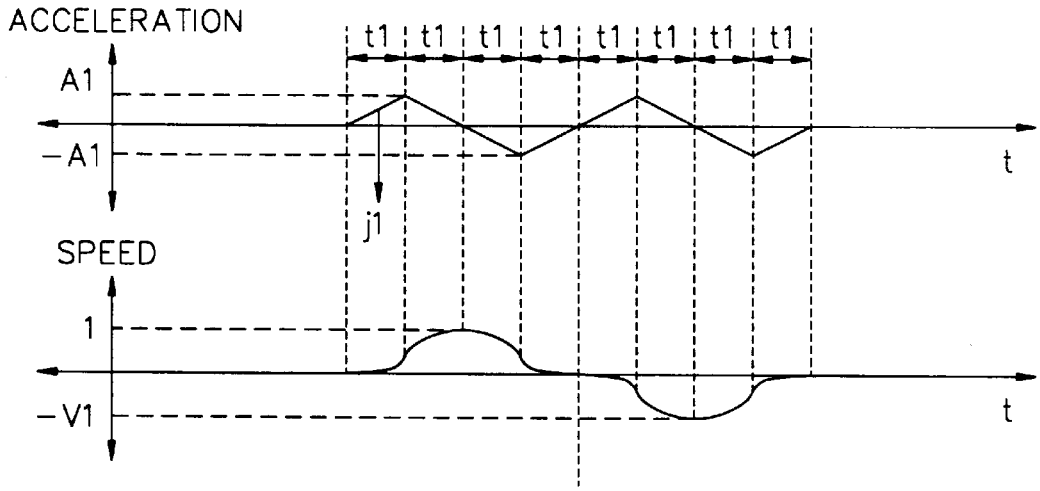
FIG. 15 is a view illustrating a speed and acceleration of a cage in a cage stop height readjusting zone according to the present invention.
Figure 16:
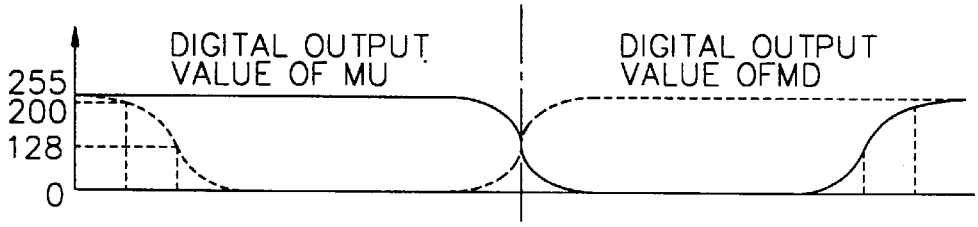
FIG. 16 is a view illustrating a digital value of a position detection signal from a position detector according to the present invention.

If Dist<0.625 m in Step S132 and since in the interval "a" shown in FIG. 17, t2 is 0, and t1 is 0.5 as shown in FIG. 15, then the new value J (namely, $J_1$) is obtained based on the cage stop height adjusting distance Dist in $Dist-2J(k_1T)^3$ in Step S133.

In addition, if Dist≧0.625 m in Step S132, since the reference value of J is 0.25, and t1 is fixed to 0.5 in the interval "b" as shown in FIG. 17, then $k_2T$, namely, t2 is obtained based on $Dist-2J(k_1T)^3+J(k_1T)^2(k_2T)$, and t2 is instituted, thus obtaining a new value of J (namely, $J_2$) in Step S134.

As a result, the shaped speed pattern is generated in accordance with the constant values T1, T2 and J1, and the CPU 10 outputs a speed instruction signal V* to the inverter 111 based on the speed pattern. The inverter 111 phase-converts the speed instruction signal V* of the main controller 110, thus driving the motor 106 so that the cage 100 is accurately stopped at the zero level.

As described above, in the present invention, the distance between the zero level and the cage is obtained using the output signals from the position detection rotary encoder and the position detector, the constant value of the shaped speed pattern function is computed in accordance with the obtained distance, and the speed instruction signal V* is generated based on the speed pattern by the computed constant values, thus enhancing the performance of the cage stop height readjusting operation.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A cage stop height readjusting method for an elevator system wherein a cage is stopped at a zero level by re-running the cage when the cage is positioned in a cage stop height adjusting zone, the method comprising:

a first step for obtaining minimum values of first and second position detection signals output from position detectors when the cage is stopped at a stop level and obtaining maximum values of the first and second position detection signals when the cage is stopped at a certain distance from the stop level to set a cage stop height adjusting zone;

a second step for performing a cage stop height adjusting operation when the cage is stopped in the set cage stop height adjusting zone;

a third step for initializing a buffer storing a relative distance value when the cage comes into a door zone and storing a running direction of the cage; and a fourth step for storing a computed value, which is obtained by accumulatively summing the number of pulses in a pulse signal from a position detection rotary encoder, into the buffer as the relative distance value until the cage coming into the door zone is stopped.

2. The method of claim 1, further comprising:

a fifth step for reading the stored running direction of the cage when the cage is stopped in the cage stop height adjusting zone and obtaining the current position of the cage which is stopped.

3. The method of claim 2, wherein in said fourth step, the current position of the cage equals "the stored value of the buffer+the zero level value−125 mm" when the cage is moved in an up-travel direction, and the current position of the cage equals "the stored value of the buffer+the zero level value+125 mm" when the cage is moved in a down-travel direction.

4. The method of claim 2, wherein in said fifth step, the cage stop height adjusting distance is computed by subtracting a zero level value from the current position of the cage when the current position of the cage is above the zero level, and the cage stop height adjusting distance is computed by subtracting the zero level value from the current position of the cage when the current position of the cage is below the zero level.

5. The method of claim 2, wherein in said seventh step, the type of the speed pattern is determined based on the reference distance.

6. The method of claim 5, further comprising:

a sixth step for computing a cage stop height adjusting distance from a zero level to the current position at which the cage is stopped.

7. The method of claim 6, further comprising:

a seventh step for computing a speed pattern constant value for obtaining a speed pattern for re-running the cage based on the computed cage stop height adjusting distance after setting the re-running direction of the cage.

8. The method of claim 7, wherein the second step includes steps of generating a speed pattern based on the computed speed pattern constant value, generating a final speed instruction signal based on the generated speed pattern and re-running the cage based on the final speed instruction signal.

* * * * *